United States Patent [19]

Moss et al.

[11] Patent Number: 4,812,867

[45] Date of Patent: Mar. 14, 1989

[54] APPARATUS FOR PROCESSING AN EXPOSED PHOTOGRAPHIC FILM WOUND ON A SPOOL

[75] Inventors: Brian F. Moss, Chelford; Richard J. Brent, Handforth, both of England

[73] Assignee: Ciba-Geigy AG, Basel, Switzerland

[21] Appl. No.: 168,413

[22] Filed: Mar. 15, 1988

[30] Foreign Application Priority Data

Mar. 25, 1987 [GB] United Kingdom ..... 8707133

[51] Int. Cl.[4] ..... G03D 13/06

[52] U.S. Cl. ..... 354/313; 354/323; 354/330

[58] Field of Search ..... 354/310, 312, 313, 314, 354/316, 323, 329, 330

[56] References Cited

U.S. PATENT DOCUMENTS

| | | | |
|---|---|---|---|
| 1,395,160 | 10/1921 | Stockwell | 354/313 |
| 1,615,880 | 2/1927 | Lucas | 354/310 |
| 4,586,803 | 5/1986 | Moss et al. | 354/313 |
| 4,664,498 | 5/1987 | Moss et al. | 354/313 |
| 4,678,307 | 7/1987 | Moss et al. | 354/313 |
| 4,678,308 | 7/1987 | Moss et al. | 354/313 |
| 4,678,309 | 7/1987 | Moss et al. | 354/313 |
| 4,702,582 | 10/1987 | Moss et al. | 354/313 |

*Primary Examiner*—A. A. Mathews

*Attorney, Agent, or Firm*—Burns, Doane, Swecker & Mathis

[57] ABSTRACT

An apparatus for the day light processing of an exposed photographic film wound on a spool including an essentially cylindrical container, a lid to close the container, both made of a material impervious to light, together with a device to rotate the spool with the film wound therein and a film retaining device located in the container. The film retaining device includes at least one tongue extending inwardly from the inner wall of the container, which upon the rotation of the spool in an unwinding direction, enters between a front end of the film and a first outer winding of the wound film and guides the front end to a stop.

8 Claims, 8 Drawing Sheets

APPARATUS FOR PROCESSING AN EXPOSED PHOTOGRAPHIC FILM WOUND ON A SPOOL

BACKGROUND OF THE INVENTION

1. Field of the Invention

The invention relates to a processing apparatus for the processing of exposed photographic film.

2. Background Description

Such an apparatus is described for example in EP-A No. 180 545 (U.S. Pat. No. 4,678,307). In order to assure the uniform wetting of the surface of the film in such an apparatus, retaining means are provided whereby the coil of film located on the spool may be expanded and contracted in a controlled manner. In the apparatus according to EP-A-180 545 these film retaining means are in the form of hooks. In another apparatus known for example from U.S. Pat. No. 4,586,803 two pointed barbs are provided; they are mounted at the lower end of the part of the apparatus containing the processing liquid and are protruding into the tank. The function of these hoods and barbs is to penetrate into the transport holes of the film perforations and to hold the film in this manner.

Film retaining means of this type are suitable for films with perforations and of a certain film format only. Furthermore, the capture and holding of perforated films is very often left to accident, in particular as different films frequently have different stiffnesses and the forward end is often curved differentially. These film retaining means are therefore operating in actual practice with a low degree of reliability. Further processing devices of this type are described in EP-A-197 002 (U.S. Pat. No. 4,678,309) and U.S. Pat. No. 4,678,308. These devices are equipped with profiles of varying thickness on the surface of an intermediate bottom of the part of the apparatus containing the processing liquid. This specific configuration of these profile elements is intended to effect the loosening and the gathering of a part of the wound film. In particular, the resulting pumping action is to cause the processing liquid to contact the surface of the film better and more uniformly. These profile elements cannot hold the film and furthermore, only part of the film on the spool is being loosened or gathered. In particular, the windings closest to the core of the spool are insufficiently expanded and wetted by the processing liquid.

The disadvantage of the aforedescribed film retaining means and profile elements is that the secure holding of the film and the controlled expansion and contraction of the entire film wound on the spool, are not assured. The uniformity of the wetting of the emulsion side of the film by fresh processing liquid is inadequate in the known devices.

A further processing apparatus is described in U.S. Pat. No. 4,702,582, which contains no film retaining means and consequently cannot make possible the controlled expansion and contraction of the wound film. Correspondingly, the uniformity of the wetting of the film surface by the processing liquid is very poor.

The foregoing illustrates limitations known to exist in present devices. Thus, it is apparent that it would be advantageous to provide an alternative directed to overcoming one or more of the limitations set forth above. Accordingly, a suitable alternative is provided including features more fully described hereinafter.

SUMMARY OF THE INVENTION

In one aspect of the present invention, this is accomplished by providing an apparatus for processing an exposed photographic film wound on a spool. A cylindrical container includes a lid closure. The container and lid are of a material impervious to light. Means are provided to rotate the spool with the wound film and to retain the film within the container. The means to retain the film includes at least one elastic member extending inwards from the inner wall of the container which, upon rotation of the spool in the unwinding direction, enters between the front end of the film and the first outer winding of the wound film and guides the front end to a stop. This assures the secure holding of the film without the engagement of the transport holes and makes possible the controlled loosening and contraction of the entire film located on the spool.

The foregoing and other aspects will become apparent from the following detailed description of the invention when considered in conjunction with the accompanying drawing figures. It is to be expressly understood, however, that the drawing figures are not intended as a definition of the invention but are for the purpose of illustration only.

BRIEF DESCRIPTION OF THE DRAWING FIGURES

DETAILED DESCRIPTION

Figure 1:
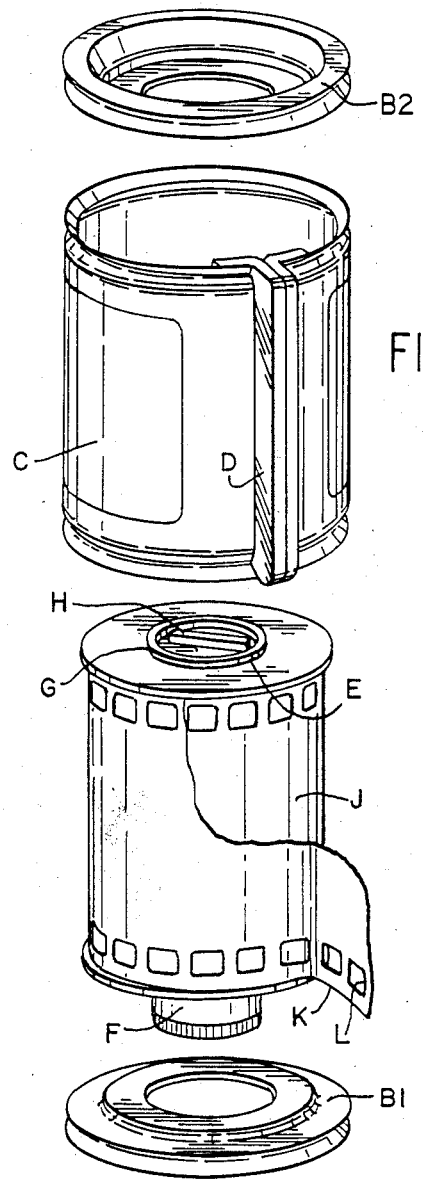
FIG. 1 is an exploded view illustrating an embodiment of a 35 mm film cassette loaded with a piece of film.

FIG. 1 shows a conventional 35 mm film cassette comprising two end caps B1 and B2 and a cassette body C, together with a film outlet D formed by the pinching together of the two ends of the metal strip constituting the cassette body C. After the assembly, the cassette body C contains a spool E with a longer end F of the core and a shorter end G of the core. Inwardly from the shorter end G, a transverse web H is located as the point of attack for an external element to rotate the spool E. The film wound on the spool E is designated J. The initial piece of the film advancing in front is designated K and the transport holes are designated L.

Figure 2:
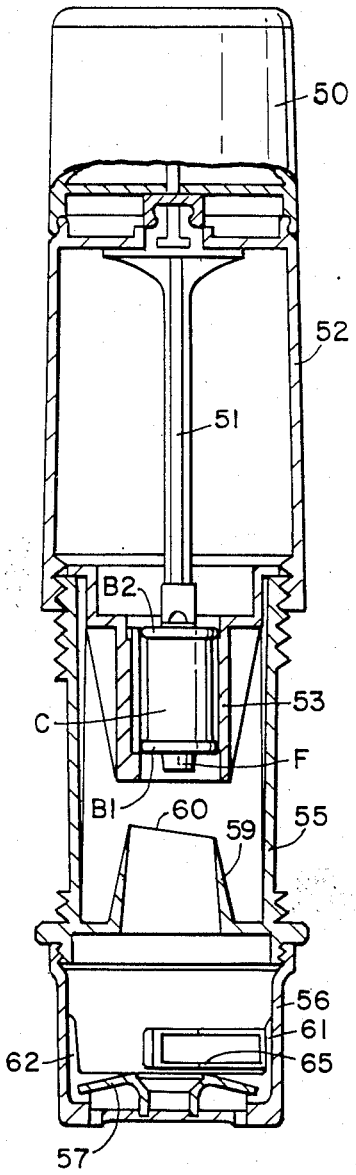
FIGS. 2 and 3 are cross-sectional views illustrating an embodiment of the invention.
Figure 3:
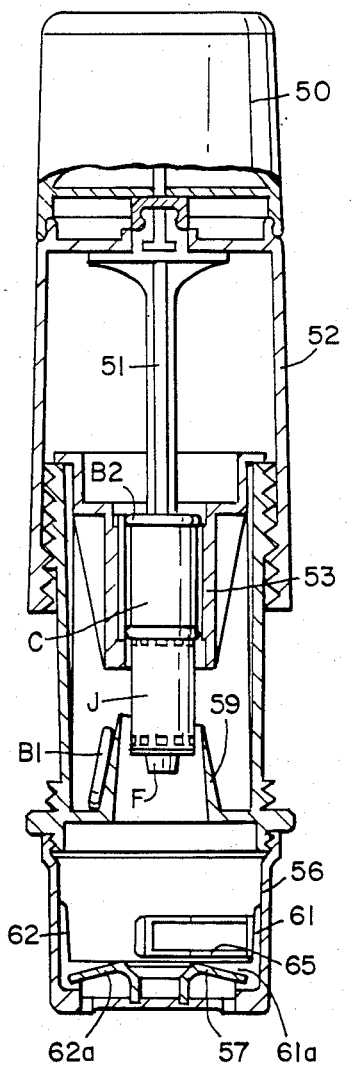
Figure 4:
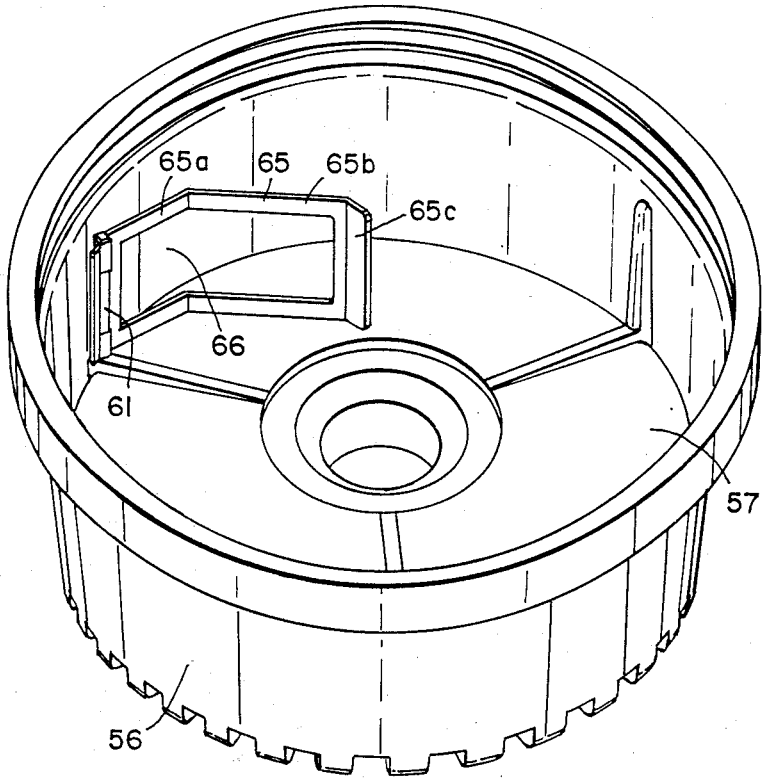
FIG. 4 is an enlarged perspective view of an embodiment of a container containing the processing liquid of the invention.
Figure 5:
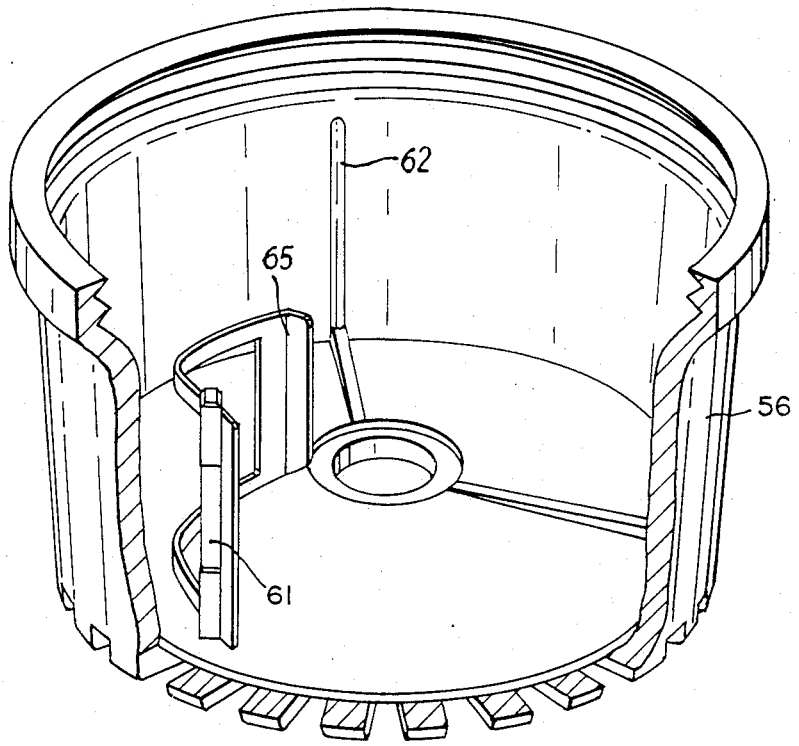
FIG. 5 is a partial sectional view of the container according to FIG. 4.
Figure 6:
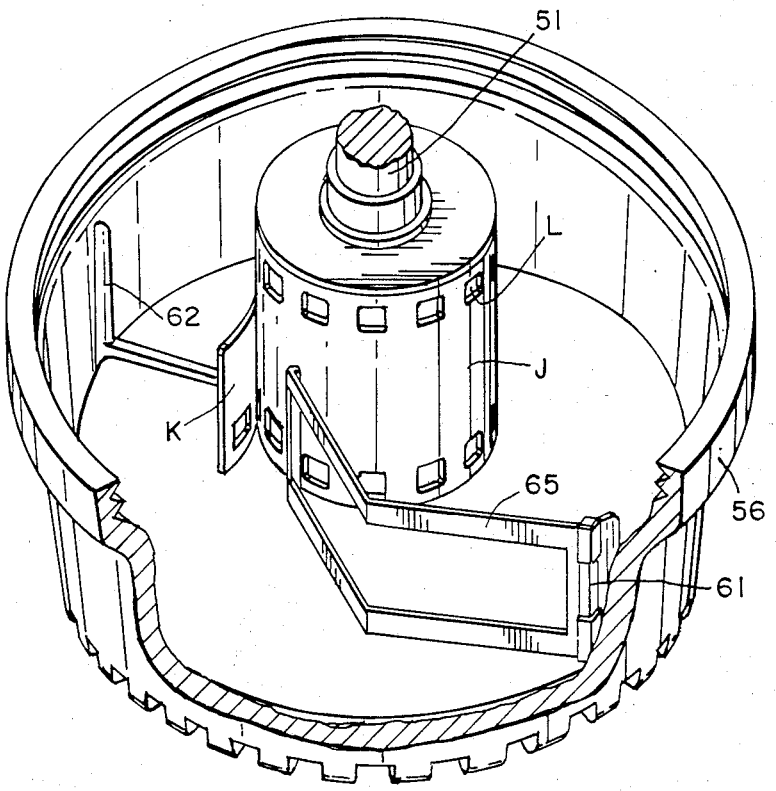
FIGS. 6 to 9 are further partial sectional views of the container in different unwinding stages of a film located therein.
Figure 7:
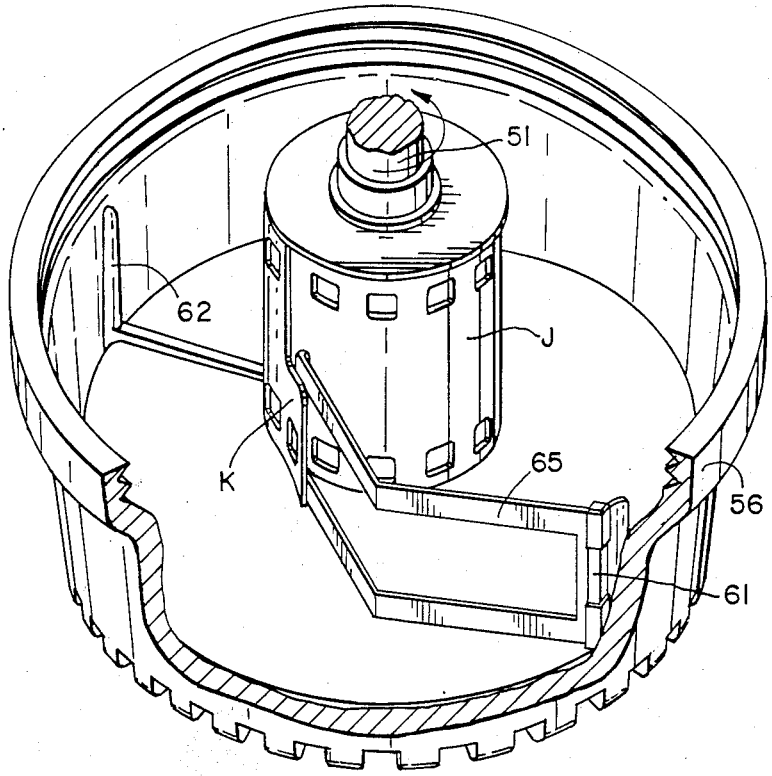
Figure 8:
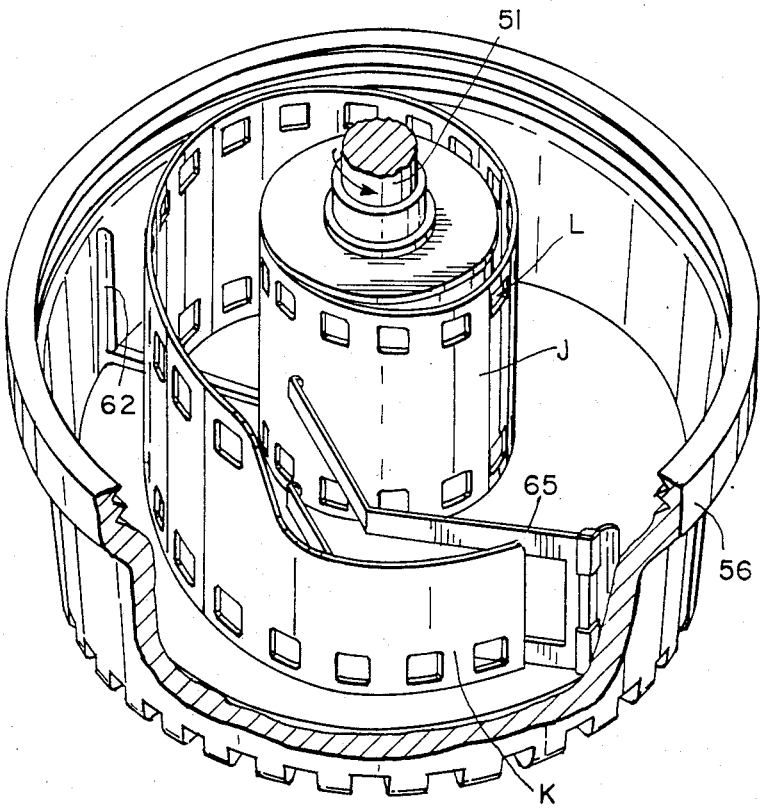
Figure 9:
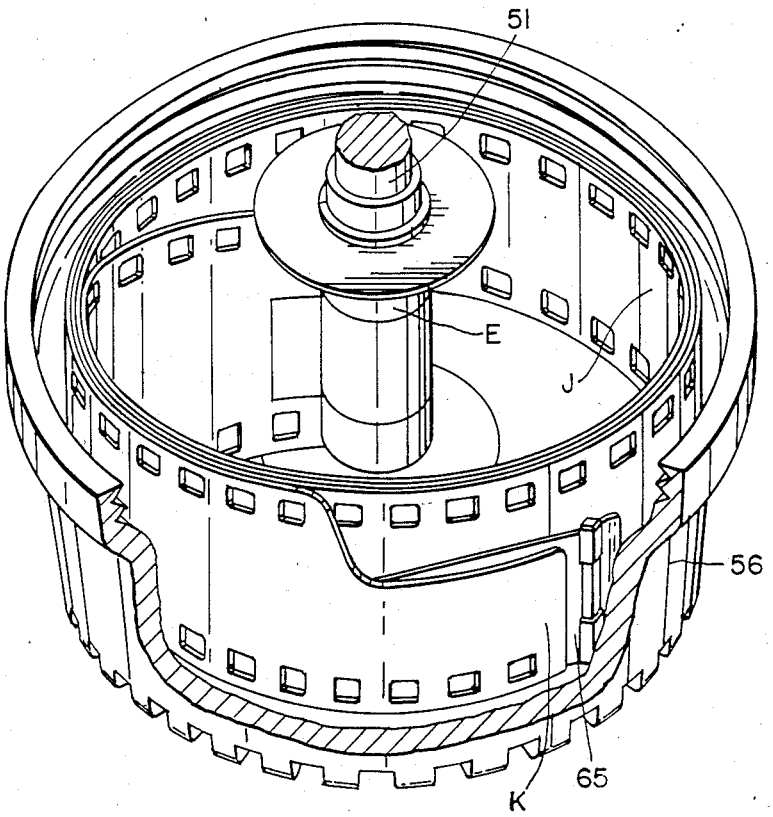

The processing apparatus shown as an example in FIGS. 2 and 3 is essentially similar in its configuration to the previously mentioned apparatus disclosed in EP-A-197 002, with the exception of the film retaining means to be explained below. The description of the apparatus may therefore be restricted to the details relevant to the understanding of the invention.

According to the figures, the apparatus comprises an essentially cylindrical container 56, carrying a coaxial, cylindrical cap 55 and being screwed together with it in a releasable manner. The cap 5 has at its upper end an outside threading engaging a corresponding internal threading of a screw lid 52. The lid 52 may be screwed off and in the screwed on state may be moved up and down by rotation. The container 56, the cap 55 and the lid 52 are made of a material impervious to light.

A holder 53 is located in the cap 55, into which a film cassette C may be inserted. A tubular guide 59 extends from the lower end of the cap 55 upward to below the holder 53.

In the lid 52 a coaxial plunger or mandrel 51 is located, which with its lower end enters the spool E. The plunger 51 is rotatable and may be driven by a motor located on the lid 52. The entire assembly is laid out similar to that disclosed in EP-A-197 002 so that by rotating the screw lid 52 it may be moved downward together with the plunger 51 into the position shown in FIG. 3, whereby the spool E carrying the wound film J is pushed partially downward from the cassette C. The joint of the plunger 51 with the spool E (by means of the web H) remains stationary during rotation. Thereby the winding of the film J is tightened, so that it may be ejected easier and undamaged. By further rotation the lid 52 may be moved further down, until it engages at the external threading provided on the lower end of the cap 55. The spool E with the wound film J is then completely ejected and arrives through the tubular guide 59 in the container 56 located below, wherein finally the film is processed with the processing liquid located therein. Throughout the process the film spool E is held by the plunger 51 and may be rotated by the motor 50 in the winding or unwinding direction. Following the completion of the processing of the film, the container 56 and the cap 55 are unscrewed and the film removed, together with the spool E.

To this extent, as mentioned above, the apparatus described essentially corresponds to that disclosed in EP-A-197 002. The container 56 and the parts essential for the invention and contained therein, will now be explained.

The height of the container 56 shown in FIGS. 4 to 9 is adequate to receive the spool E with the wound film J. In the lower part of the container 56 an intermediate bottom 57 sloping in the direction of the inner wall of the container is located, the diameter of which is slightly smaller than the internal diameter of the container 56. The intermediate bottom 57 forms a light labyrinth, through which by means of orifices not identified in detail in the container bottom, processing liquid may be introduced into the container 56, but the entry of light is prevented. A recess is provided concentrically in the center of the intermediate bottom to receive the longer core end F of the spool E.

To reinforce the intermediate bottom 57, ribs may be applied to it. In this embodiment three of such ribs **61*a* to 63*a* are located in the intermediate bottom 57, which extend radially to three holding ledges 61 to 63 on the internal wall of the container. The three holding ledges 61 to 63 are located uniformly spaced apart in the circumferential direction on the internal wall of the container 56 and extend from the gap between the inner wall of the container and the intermediate bottom 57 to just under the internal threading of the container 56**.

At least on one of the holding ledges 61 to 63 (for the example on the ledge 61), a tongue 65 is mounted, which extends inwardly from the inner wall of the container 56. The tongue 65 is made of an elastic material, preferably a plastic with a thickness of approximately 250 μm, but it may also consist of a rigid material fastened pivotably in the direction of the inner wall of the container against the force of a spring, to one of the holding ledges 61 to 63. By leaving an opening 66 the flexibility of the tongue 65 may be increased further, which then has the shape of the strap shown in FIGS. 2 to 9. The tongue 65 upon the rotation of the spool E in the unwinding direction enters between the forward piece K of the film and the first outer winding of the wound film J, thereby forming the film retaining means.

In the embodiments of FIGS. 4 to 8, the tongue 65 is shown bent or buckled twice along its length in the direction of the center of the container. It may, however, also be bent only once at approximately half-length in the direction of the container center or be continuously curved in the direction of the center of the container. In all of the forms of embodiment the end **65*a* on a fastening side of the tongue 65 includes a smaller angle with the inner wall of the container than the free end 65*b* or 65*c* protruding toward the center. This configuration of the tongue 65 and the fact that the length of the tongue 65 is chosen so that the free end reaches a point shortly before the recess in the intermediate bottom 57, insures that on the one hand it enters upon the rotation of the spool E in the unwinding direction between the forward piece K of the film and the first outer winding of the wound film J, and on the other hand, does not interfere with the introduction of the spool E into the container 56**.

In the following, the manipulation and the mode of operation of the apparatus described and in particular of the improved film retaining means is explained in a summary manner with reference to the drawing.

A film cassette C with an exposed film is inserted with the longer core end F of the spool E downwardly into the holder 53. The lid 52 is then screwed onto the cap 55, whereby the lower end of the plunger 51 is joined fixedly in rotation to the spool E (by means of the transverse web H). In FIG. 2, this operating phase of the apparatus is shown. By the screwing on of the lid 52, it is moved downward together with the plunger 51, whereby the spool E with the wound film J, which is being tightened by the rotating motion, is partially ejected in the downward direction from the cassette C. The lower end cap B1 of the cassette C forced off in the process comes to rest against the outer wall of the tubular guide 59, as shown in FIG. 3. By continued rotation, the lid 52 is moved farther down until it engages the external threads on the lower end of the cap 55. The spool E is thereby completely ejected together with the wound film J, and arrives through the tubular guide 59 in the container 56 located beneath it. The longer core end F of the spool is received by the recess in the intermediate bottom 57. The shorter core end G of the spool E is connected fixedly in rotation with the plunger 51 by means of the transverse web H. The processing liquid is usually introduced into the container 56 prior to the insertion of the spool E with the wound film J. This may be effected by pouring through a specially designed lid or by means of an inlet tube located above the liquid level in the side wall of the container 56 (not shown). In the aforedescribed example of an embodiment of the apparatus the processing liquid arrives in the container 56 through orifices in its bottom, by simply setting the apparatus into a bath of the processing liquid. The height of the liquid level in the bath must be adequate to entirely cover the spool E in the container 56.

Subsequently, the plunger 51 and thus the spool E are rotated by the motor 50 on the lid 52. FIGS. 6 to 9 show different stages of the unwinding of the film in the container 56.

As a result of the rotation of the spool E in the unwinding direction, in this case counterclockwise, the tongue 65 elastically resting against the winding J, enters between the front end K of the film and the first outer winding of the wound film J and guides the front end K to a stop between the tongue 65 and the inner wall of the container. The continued rotation of the spool E loosens the wound film J.

The tongue 65 is being pressured by the first windings in the direction of the inner wall of the container and thus does not interfere with the continuing expansion process.

As a result of the expansion of the wound film J, the emulsion of each individual winding comes into contact with fresh processing liquid. After the wound film has been completely expanded, the direction of rotation of the motor 50 is reversed. The wound film J is thereby contracted and the emulsion of each individual winding again is exposed to fresh processing liquid, which by the further contraction of the film J is pressured out from the windings.

The tongue 65 returns by virtue of its elasticity into its initial position and the process of the widening and contraction of the wound film is continuously repeated in keeping with the processing time specified.

Following the completion of the processing time from the bath with the processing liquid and the latter is usually poured from the container 56 and discarded. Another processing bath is prepared and the process repeated. In the case wherein a single bath solution, for example a developer or fixer bath, is used, water is poured into the bath and the apparatus returned to the bath. By back and forth rotation, the film is rinsed. Within the period of time specified for this processing step, the process is repeated several times with fresh water. The container 56 is then screwed off the cylindrical cap 55 and the spool E with the film removed for inspection.

Following the removal of the lid 52 from the cap 55, the empty film cassette C and the lower end cap B1 may be removed from the apparatus.

Other, simpler forms of embodiment of the invention consist only of a container 56 with the film retaining means according to the invention and a screw-on lid. In this case a coaxially rotatable shaft is provided in the lid, the end of which located in the container 56 may be joined fixedly in rotation with the spool E (by means of its transverse web H). The other end of the shaft located outside the container is equipped with means (for example a crank) to rotate the shaft or it may be connected with a motor. This simpler form of embodiment comprises no ejection means and consequently must be loaded in darkness with the film removed from the cassette C and still located on the spool E. However, this process is easily carried out even by unskilled persons in view of the simplicity of the apparatus. The further manipulation and mode of operation of this simple apparatus is similar to that set forth above relative to the example of the embodiment described.

The advantage of the film retaining means according to the invention resides in the feature of the relative simple operation of the apparatus equipped with it. The tongue 65 makes it possible to hold different film formats and in particular also those without perforations.

The configuration of the film retaining means in the form of the above-described tongue 65 assures the secure holding of the front end of the film. The wound film J may be loosened and contracted in a controlled manner by the rotation of the spool E. The emulsion of each winding is wetted uniformly with the processing liquid. The film retaining means in combination with the aforedescribed examples thus make possible a highly uniform processing of the exposed photographic film.

While this invention has been illustrated and described in accordance with a preferred embodiment, it is recognized that variations and changes may be made therein without departing from the invention as set forth in the claims.

What is claimed is:

1. Apparatus for the processing of exposed photographic film wound on a spool, comprising a substantially cylindrical container, a lid connected to close said container, said lid and container being made of a material impervious to light, together with means to rotate the spool with the wound film and film retaining means provided within the container, wherein the film retaining means includes at least one elastic tongue fastened to and extending inwards from an inner wall of the container, which upon the rotation of the spool in an unwinding direction, enters between a front end of the film and a first outer winding of the wound film and guides said front end to a stop to prevent said front end from slipping around said inner wall as said film unwinds in the container.

2. Apparatus according to claim 1, wherein the tongue is curved in a direction toward the center of the container.

3. Apparatus according to claim 1, wherein the tongue includes a bend in a direction toward the center of the container, said bend being at approximately one half of the length of said tongue.

4. Apparatus according to claim 1, wherein the tongue is bent twice along the length thereof in a direction toward the center of the container.

5. Apparatus according to claim 1, wherein the end on a fastening side of the tongue includes an angle with the inner wall of the container smaller than the angle between the free protruding end of the tongue and the inner wall of the container.

6. Apparatus according to claim 1, wherein the tongue is made of plastic.

7. Apparatus according to claim 1, wherein the tongue is mounted on holding ledges in a manner such that said tongue may be deflected against the force of a spring in a direction toward the inner wall of the container.

8. Apparatus according to claim 1, wherein said tongue includes an opening, whereby said tongue has the configuration of a strap.

* * * * *